US007975433B2

(12) United States Patent
Dunstan

(10) Patent No.: US 7,975,433 B2
(45) Date of Patent: Jul. 12, 2011

(54) DOOR MOUNT FOR A SAFE

(75) Inventor: Brett Dunstan, Hallam (AU)

(73) Assignee: Lokaway Pty. Ltd., Hallam, Victoria (AU)

( * ) Notice: Subject to any disclaimer, the term of this patent is extended or adjusted under 35 U.S.C. 154(b) by 715 days.

(21) Appl. No.: 11/993,201

(22) PCT Filed: Jul. 6, 2006

(86) PCT No.: PCT/AU2006/000983

§ 371 (c)(1),
(2), (4) Date: Dec. 19, 2007

(87) PCT Pub. No.: WO2007/006098

PCT Pub. Date: Jan. 18, 2007

(65) Prior Publication Data

US 2009/0313901 A1 Dec. 24, 2009

(30) Foreign Application Priority Data

Jul. 7, 2005 (AU) ..... 2005903611

(51) Int. Cl.
*E05D 15/58* (2006.01)

(52) U.S. Cl. ..... 49/254; 49/257; 49/258; 16/366; 109/74

(58) Field of Classification Search ..... 49/254, 49/257, 258, 259, 261; 109/74, 59 R, 64; 16/366 X, 342, 371, 379
See application file for complete search history.

(56) References Cited

U.S. PATENT DOCUMENTS

| | | | | |
|---|---|---|---|---|
| 428,402 | A * | 5/1890 | Morris | 16/366 |
| 825,253 | A | 7/1906 | Watson | |
| 888,545 | A * | 5/1908 | Sperry | 49/253 |
| 892,514 | A * | 7/1908 | Fuller | 109/69 |
| 915,397 | A | 3/1909 | Weiss | |
| 958,624 | A | 5/1910 | Glazier | |
| 990,469 | A | 4/1911 | Anderson | |
| 1,155,161 | A * | 9/1915 | Ramsey | 49/246 |
| 1,873,522 | A | 8/1932 | Abbott et al. | |
| 2,936,206 | A | 5/1960 | Wilmer et al. | |
| 3,270,462 | A | 9/1966 | Obadal et al. | |
| 3,481,288 | A | 12/1969 | Teleky | |
| 3,619,853 | A * | 11/1971 | Merrill | 16/366 |
| 3,788,689 | A | 1/1974 | Lloyd | |
| 4,070,074 | A | 1/1978 | Rohme | |
| 4,262,447 | A | 4/1981 | Schneier et al. | |
| 4,294,040 | A | 10/1981 | Crotti | |
| 4,367,684 | A | 1/1983 | Jucker | |
| 4,389,748 | A * | 6/1983 | Grossman | 16/278 |

(Continued)

FOREIGN PATENT DOCUMENTS

AU A-17475/88 6/1988

(Continued)

*Primary Examiner* — Jerry Redman
(74) *Attorney, Agent, or Firm* — D. Peter Hochberg; Sean F. Mellino; Daniel J. Smola

(57) ABSTRACT

A security door construction has a pair of door hinges fixed to the door, a pair of frame hinges fixed to the frame and a pair of intermediate hinges by combined links which allow the door hinge to swing outside the plane of the door opening when the door is opened through 180°. Slide motion of the door is imparted by a door handle and a reaction rod which acts against a link.

7 Claims, 4 Drawing Sheets

U.S. PATENT DOCUMENTS

| | | | | | |
|---|---|---|---|---|---|
| 4,548,330 | A | | 10/1985 | Hewitt et al. | |
| 4,564,975 | A | * | 1/1986 | Kuffner | 16/370 |
| 4,665,585 | A | * | 5/1987 | Westin | 16/302 |
| 4,679,353 | A | | 7/1987 | Langenbach et al. | |
| 4,704,970 | A | * | 11/1987 | Sanderson et al. | 109/73 |
| 4,712,490 | A | | 12/1987 | Lichter | |
| 4,727,622 | A | * | 3/1988 | Tsuneki | 16/368 |
| 4,852,503 | A | | 8/1989 | Lichter | |
| 4,932,160 | A | | 6/1990 | Sperko | |
| 5,056,262 | A | | 10/1991 | Schweiss et al. | |
| 5,282,293 | A | * | 2/1994 | Pedoeem | 16/342 |
| 5,685,046 | A | * | 11/1997 | Neag et al. | 16/366 |
| 5,931,104 | A | | 8/1999 | Horn et al. | |
| 5,953,860 | A | * | 9/1999 | Morgan et al. | 49/257 |
| 5,971,515 | A | | 10/1999 | Baker et al. | |
| 6,161,336 | A | | 12/2000 | Ziv-Av | |
| 6,564,428 | B2 | * | 5/2003 | Richard et al. | 16/366 |
| 6,842,944 | B2 | * | 1/2005 | Maurer | 16/366 |
| 6,842,945 | B2 | * | 1/2005 | Hiramatsu | 16/366 |
| 7,100,241 | B2 | * | 9/2006 | Zetti | 16/304 |
| 7,249,645 | B2 | * | 7/2007 | Herrmann et al. | 180/68.5 |
| 7,404,363 | B2 | * | 7/2008 | Dunstan | 109/70 |
| 7,770,330 | B2 | * | 8/2010 | Brown et al. | 49/506 |
| 2001/0025398 | A1 | * | 10/2001 | Zetti | 16/370 |
| 2003/0200629 | A1 | * | 10/2003 | Schefter | 16/366 |
| 2005/0177980 | A1 | * | 8/2005 | Herper | 16/366 |
| 2006/0037519 | A1 | * | 2/2006 | Dunstan | 109/74 |
| 2009/0064908 | A1 | * | 3/2009 | Dunstan | 109/70 |

FOREIGN PATENT DOCUMENTS

| | | | | |
|---|---|---|---|---|
| AU | A-11342/95 | | | 8/1995 |
| AU | 2000 12438 | | | 7/2000 |
| CA | 2325318 | | | 5/2002 |
| DE | 39 15 502 | | | 11/1990 |
| DE | 3915502 | A1 | * | 11/1990 |
| DE | 20109557 | | | 9/2001 |
| DE | 20109557 | | | 10/2001 |
| EP | 0145079 | | | 6/1985 |
| EP | 0 577 535 | | | 1/1994 |
| EP | 577535 | A1 | * | 1/1994 |
| EP | 0637674 | | | 2/1995 |
| EP | 0607040 | | | 9/1997 |
| FR | 928207 | | | 11/1947 |
| FR | 2456198 | | | 5/1980 |
| FR | 2728010 | | | 6/1996 |
| GB | 2 038 406 | | | 7/1980 |
| GB | 2038406 | A | * | 7/1980 |
| GB | 2 155 538 | | | 9/1985 |
| GB | 2155538 | A | * | 9/1985 |
| GB | 2 250 055 | | | 5/1992 |
| GB | 2250055 | A | * | 5/1992 |
| GB | 2 264 979 | | | 9/1993 |
| GB | 2264979 | A | * | 9/1993 |
| JP | 3-271475 | | | 2/1990 |
| JP | 03271475 | A | * | 12/1991 |
| WO | WO 96/29496 | | | 9/1996 |
| WO | WO 99/50519 | | | 10/1999 |
| WO | WO 00/79084 | | | 12/2000 |
| WO | WO 01/61132 | | | 8/2001 |
| WO | WO 01/71140 | | | 9/2001 |
| WO | WO 02/059528 | | | 8/2002 |
| WO | WO 02/101185 | | | 12/2002 |
| WO | 2004033835 | | | 4/2004 |
| WO | WO 2004/033835 | | | 4/2004 |

* cited by examiner

DOOR MOUNT FOR A SAFE

CROSS-REFERENCE TO RELATED APPLICATION

This is a national stage application filed under 35 USC 371 based on International Application No. PCT/AU2006/000983, filed Jul. 6, 2006, and claims priority under 35 USC 119 of Australian Patent Application No. 2005903611 filed Jul. 7, 2005.

BACKGROUND OF THE INVENTION

1. Field of the Invention

This invention concerns safes for valuables and guns.

2. Description of the Prior Art

In our co-pending application for Patent No. PCT/AU03/001321, we describe safes with two pairs of hinges, one set is mounted on the safe body and the other set is mounted on the door. The two sets of hinges are interconnected to create an offset motion whereby the door is free to both slide left and right and to swing open and closed.

The hinges are installed inside the door opening and the door width exceeds the door opening width. The swing and slide motion allows the door to slide first to clear the door opening and then to swing toward the person opening the safe giving access to the safe interior. The geometry of this arrangement permits the door to open say 90-110°. There are instances where ammunition is kept in the safe and it would be more visible if it could be stored on shelves on the inside face of the door in the manner of egg shelves inside the door of a refrigerator. It would be more convenient if the door were to open wider say up to 180° or even 270°.

SUMMARY OF THE INVENTION

This invention provides a safe of the swing and slide type having a pair of door hinges fixed to the door, a pair of frame hinges attached to the frame and a pair of intermediate hinges fixed to both the door hinges and the frame hinges by links so that the hinge axes are all mutually parallel and the links allow the displacement of the door hinge to lie outside the plane of the door opening when the door is opened through 180°.

The door hinges may be connected to the intermediate hinges by a first link which allows the slide motion of the door. This link may be a pair of arms 5-25 mm long.

The frame hinges may be connected to the intermediate hinges by a second link and preferably this link is longer than the first link in order to give greater throw. It is this second link which allows rotation of the door and its sets of hinges into the space adjacent to the door opening, whereby the door is free to rotate through 180°. The second link may be a bar or angle member of sufficient width to space the door face from the body of the safe to permit the desired angle of swing. The width may be 50-70 mm.

The door sliding motion may be provided by a handle as described in our Patent No. PCT/AU03/001321 and the reaction rod may react against the second link instead of the rod or bar which connects the frame hinges.

BRIEF DESCRIPTION OF THE DRAWINGS

One embodiment of the invention is now described with reference to the accompanying drawings, in which.

DETAILED DESCRIPTION OF THE PREFERRED EMBODIMENTS

Figure 1:
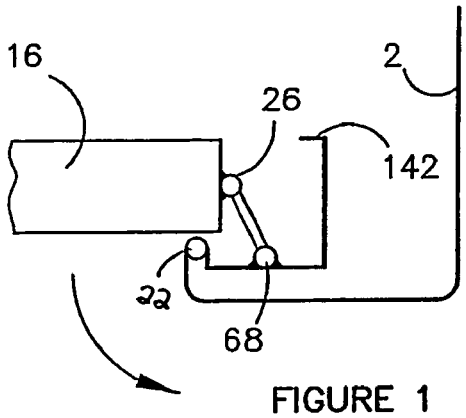
FIG. 1 is a partial sectional plan view showing the door closed omitting the reaction bar.

The safe components are numbered as in U.S. Pat. No. 7,404,363 and co-pending U.S. patent application No. 12/220,301, which is a divisional of U.S. Pat. No. 7,404,363 and extra components which occur in the embodiment described below are given numbers which follow on from the numbering in the prior U.S. patent and U.S. application.

In U.S. Pat. No. 7,404,363 and co-pending U.S. patent application No. 12/220,301, a safe having a body is closed by a safe door which lies in front of the hinges upon which it swings thereby rendering the hinges inaccessible to tampering. Body has aligned upper and lower frame hinges and aligned upper and lower door hinges. Of these hinges, only frame hinge 22 and door hinge 26 are seen in the drawings of the present invention.

Figure 5:
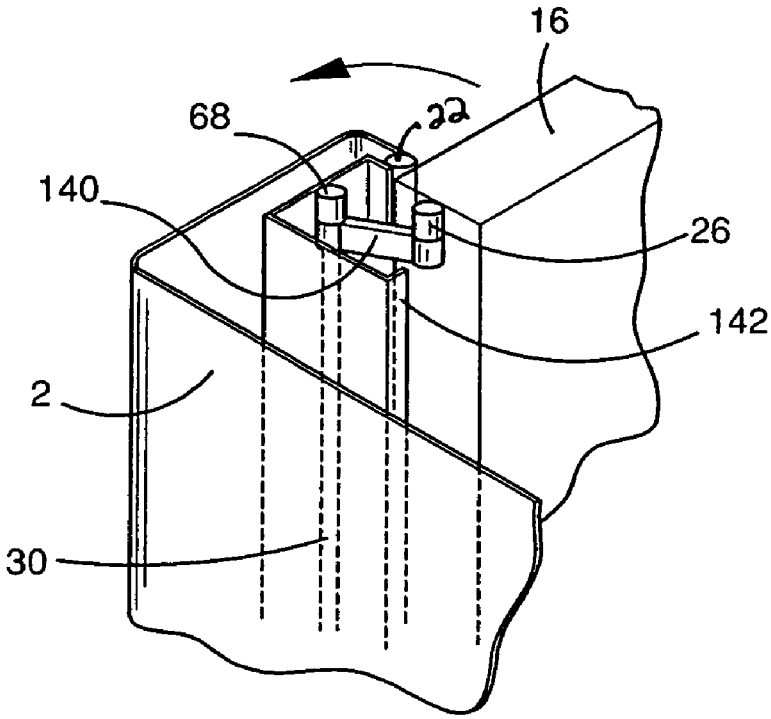
FIG. 5 is a partial perspective view of FIG. 1.
Figure 5A:
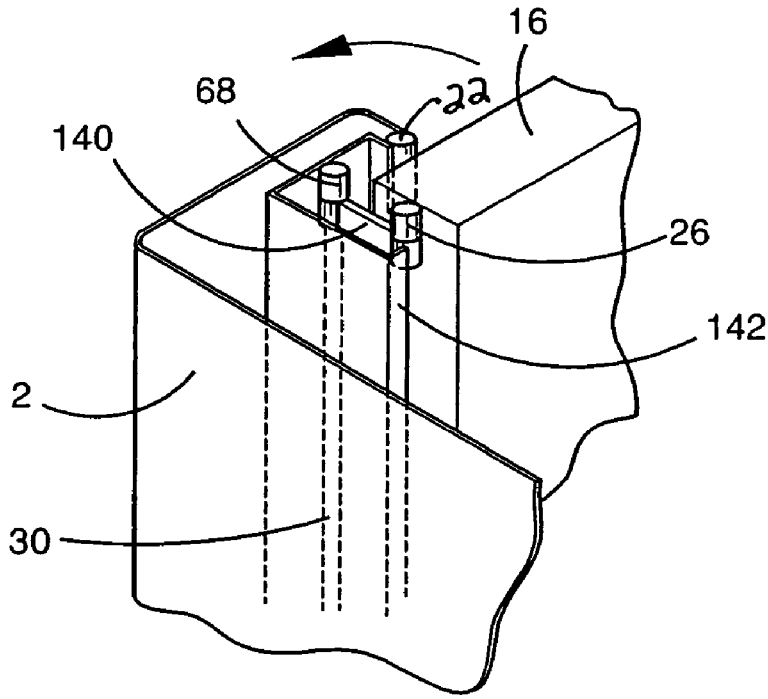
FIG. 5A is a partial perspective view of FIG. 1A.
Figure 6:
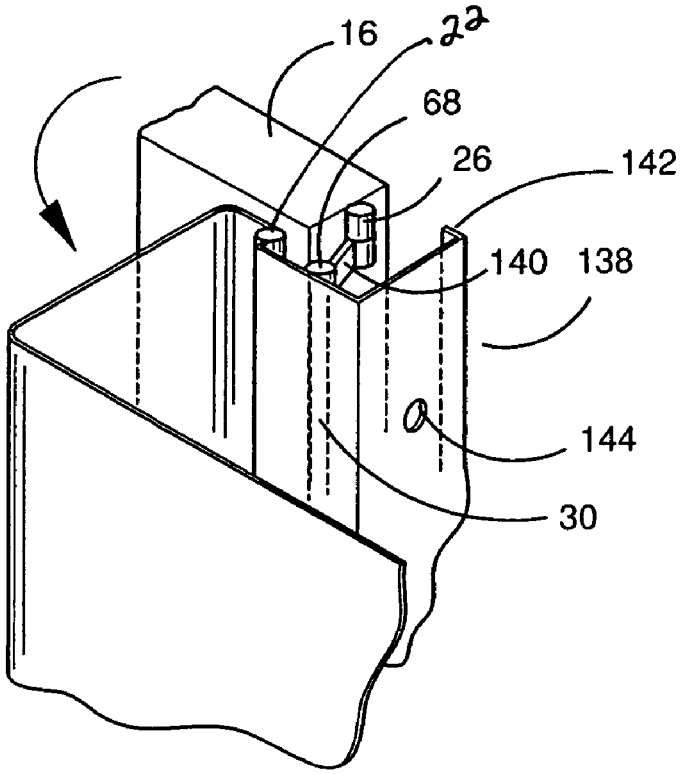
FIG. 6 is a partial perspective view of FIG. 2.

FIGS. 1 and 5 of the present disclosure show a portion of safe body 2 in a fully closed position. Body 2 supports aligned upper frame hinge 22 and lower frame hinge. Frame hinge 22 in turn supports an L-section steel link 138 as shown in FIG. 1. L-section link 138 extends substantially the full length of door 16. L-section link 138 includes a first leg 139 and a second leg 141, where first leg 139 is substantially perpendicular to second leg 141. L-section link 138 also comprises a first leg flange 143 and a second leg flange 142 for stiffening of L-section link 138. First leg flange 143 is operatively connected to frame hinge 22 which allows L-section link 138 to pivot.

Figure 1A:
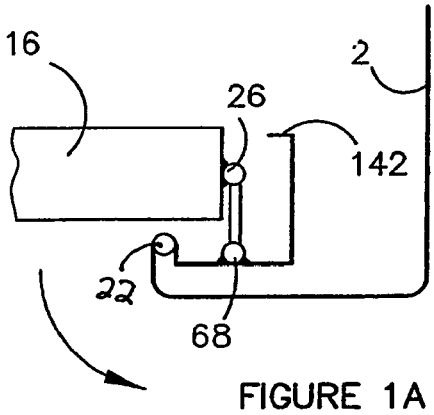
FIG. 1A is a partial sectional plan view indicating how door slide occurs from FIG. 1.
Figure 2:
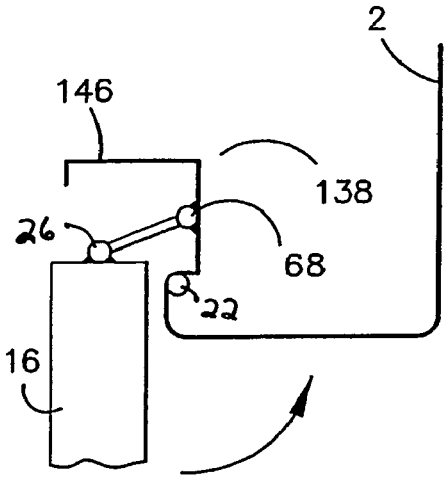
FIG. 2 is a partial sectional plan view showing the door half open omitting the reaction bar.

L-section link 138 also includes intermediate hinges 68 located on first leg 139 between first leg flange 143 and second leg 141. Preferably, intermediate hinge 68 is located midway between first leg flange 143 and second leg 141. Intermediate hinge 68 is operatively connected to upper door hinge 26 via a rigid link 140, which in turn operatively connects L-section link 138 to door 16. Link 140 pivots about intermediate hinge 68, which in turn allows door 16 to slide laterally (throw) as shown in FIGS. 1 and 1A. Door 16 also pivots about upper door hinge 26. The throw afforded by the combined links 138 and 140 allows the door 16 to slide laterally left and right in FIG. 1 and to swing open through 180° as shown in FIG. 3 which will be described below.

Figure 4:
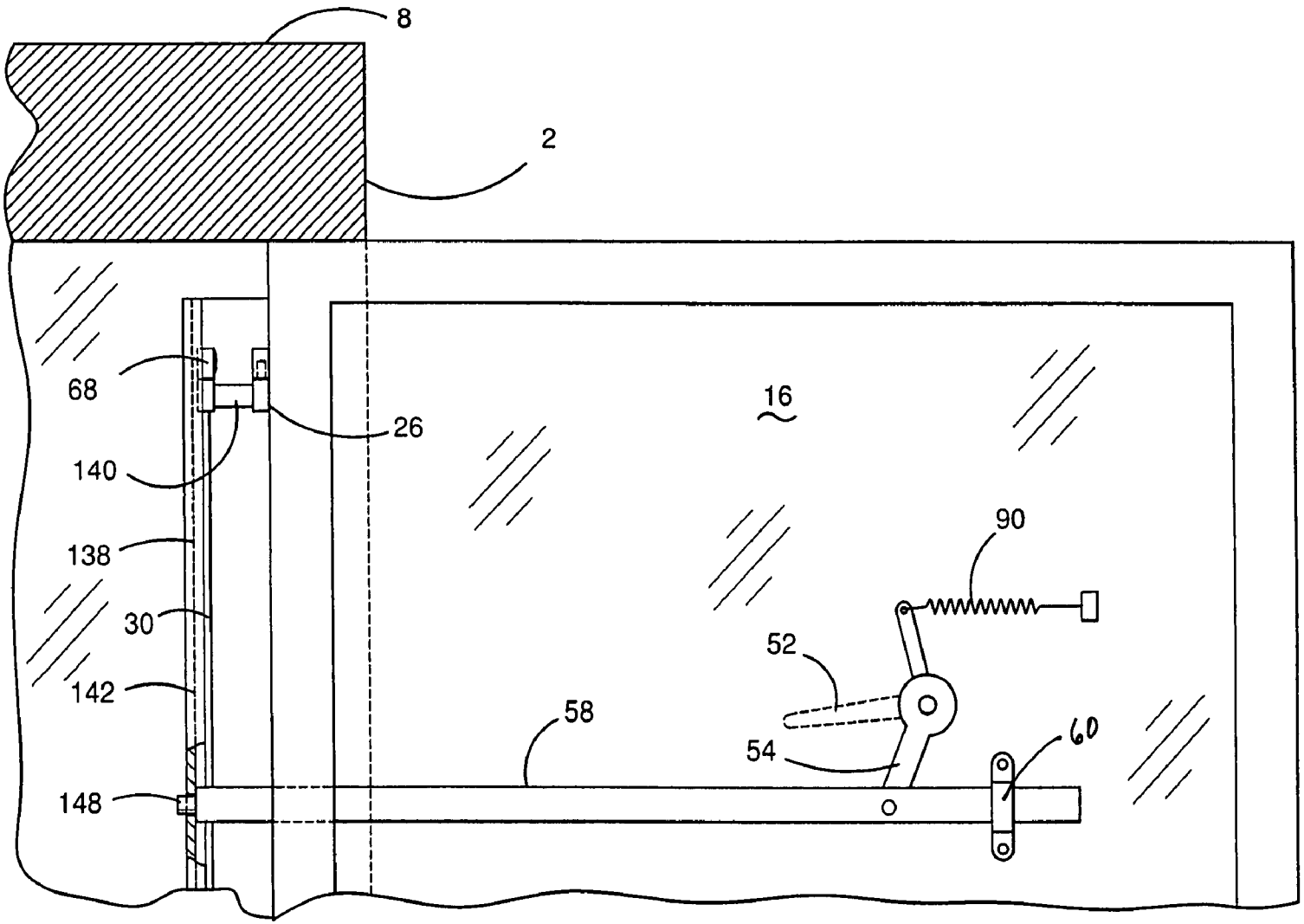
FIG. 4 is a partial front view of part of the safe with the door in the position shown in FIG. 3 shown from the inside of the door.

The present invention also includes a reaction bar 58 located on the inside of door 16 as shown in FIG. 4.

Figure 3:
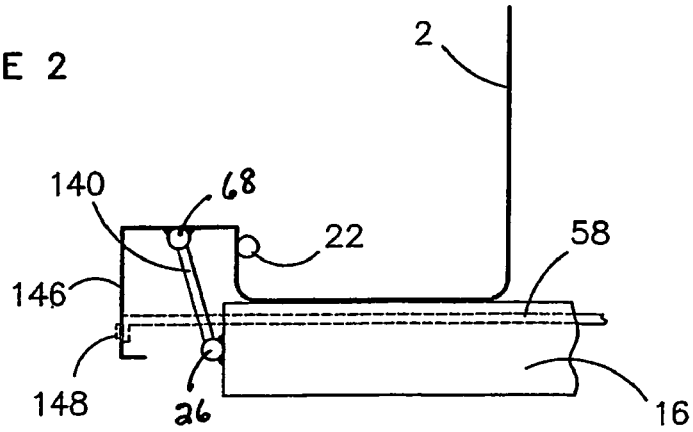
FIG. 3 is a partial section plan view showing the door fully open and the position of the reaction bar.

Referring now to FIGS. 1-4, the body 2 supports frame hinges 22 and these hinges 22 in turn support L-section steel link 138 which extends substantially the full length of the door 16. Intermediate hinges 68 are welded to the face of the first leg of the L-section steel link 138 20 mm from hinge 22. Door hinges 26 are welded to the edge of door 16. The door hinges 26 are connected to the intermediate hinges 68 by links 140 (one only shown). In this instance the links 68 are steel spacer bars 20 mm long. The throw afforded by the combined links 138 and 140 allow the door 16 to slide left and right in FIG. 1 and to swing open through 180° as shown in FIG. 3. It is still necessary to join the top and bottom intermediate hinges 68 through link 138 so that the hinges 68 and door hinge 26 act as a unitary assembly eliminating waggle in the door 16. The L-section link is stiffened by a flange 142.

Figure 7:
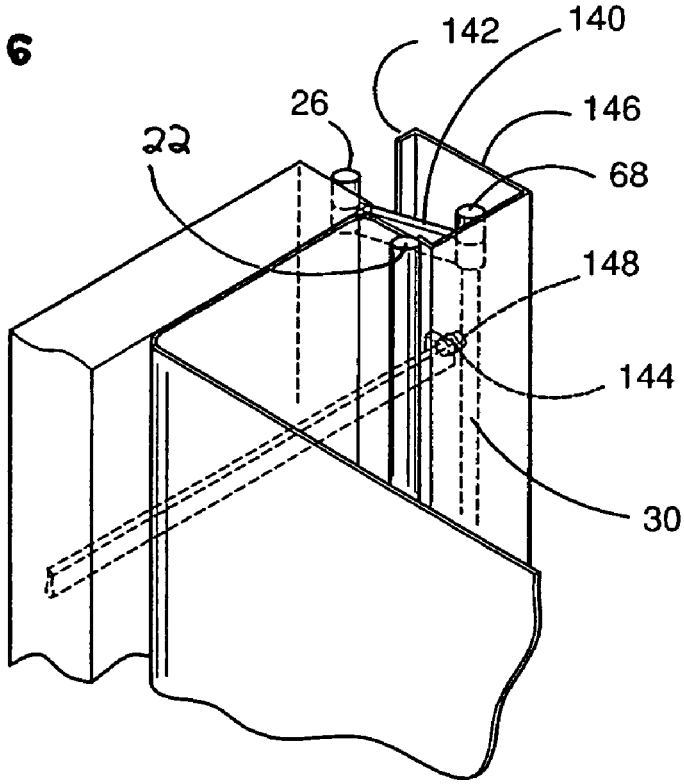
FIG. 7 is a partial perspective view of FIG. 3.

The slide motion of the door 16 requires modification in that in U.S. Pat. No. 7,404,363 and co-pending U.S. patent application No. 12/220,301, the rod connecting the top and bottom hinges is not in the same position and is not available as a reaction surface against which reaction bar 58 can abut. In FIGS. 3, 4 and 7, reaction bar 58 passes through an aperture 144 in the door edge and abuts the second leg 146 of the L-section link 138 where it is fixed by a bolt 148. Rotation of a handle 52 causes the door to slide between the positions shown in FIGS. 1 and 1A. The operaton of the door will now be explained in detail.

Rotation of handle 52 turns a crank 54 which exerts force on reaction bar 58. Reaction bar 58 reacts against the second leg 146 of the L-section link 138. As leg 146 is part of rigid L-section link 138 and door 16 is mounted on hinges, door 16 slides sideways between the positions shown in FIGS. 1, 1A, 5 and 5A. A spring 90 assists the operator to start rotation of handle 52. Aperture 144 in second leg 146 admits bolt 148 and bolt 148 anchors one end of reaction bar 58. The opposite end of reaction bar 58 is free to slide through a double bracket 60 fixed to the inside of door 16. Reaction bar 58 is subject to push and pull forces when handle 52 turns.

We have found the advantages of the above embodiment to be:

1. Wider door opening while retaining the swing and slide operation.

2. Automatic closing and safety features disclosed in co-pending Australian application nos. 2004231234, 2005201187 and 2005903610 are relevant and some of these features may be used in combination with this invention.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The claims defining the invention are as follows:

1. A security door construction, said security door construction having a fully closed position and a fully open position, said security door construction comprising:

an offset hinge assembly on one side portion of said security door construction;

a door having a top and a bottom, an inside and an outside, a closing edge and being slidably movable in a slide motion between the open position and the closed position, wherein the outside of the door comprises a closed door plane when in the fully closed position;

a door frame having a top, a bottom, a closing style and an upright against which said door closes, said upright being located on the opposite side portion of said security door construction from said offset hinge assembly, and a door slot for slidingly receiving said closing edge of said door when said door moves into the closed position and for slidingly releasing said closing edge of said door when said door moves to the open position;

wherein said door is mounted behind said door frame on said offset hinge assembly, said offset hinge assembly being located behind said door in a space protected by said door, said offset hinge assembly further comprising:

a pair of aligned door hinges fixed to the door, said door hinges having a common door hinge axis, a pair of aligned frame hinges fixed to the frame, said frame hinges have a common frame hinge axis, and a pair of aligned intermediate hinges having a common intermediate hinge axis, at least one link fixing said intermediate hinges, the door hinges and the frame hinges to render the hinges axes mutually parallel, wherein the at least one link allows for the displacement of the door hinges to lie outside the closed door plane when the door is moved to the open position through 180°.

2. A security door construction as claimed in claim 1, and further comprising a first link connecting the door hinges to the intermediate hinges for permitting a slide motion of the door.

3. A security door construction as claimed in claim 2, and further comprising a second link for connecting the frame hinges to the intermediate hinges.

4. A security door construction as claimed in claim 3, wherein the second link is longer than the first link.

5. A security door construction as claimed in claim 4, wherein the second link is a bar or angle member of sufficient width to space the door face from the security door construction to permit a desired angle of swing.

6. A security door construction as claimed in claim 5, wherein the width of said bar or angle member is 50-70 mm.

7. A security door construction as claimed in claim 5, and further including a rotary handle and a reaction rod operatively connected to the door for acting against the second link to impart a slide motion to the door.

* * * * *